US005295859A

United States Patent [19]

Kawai et al.

[11] Patent Number: 5,295,859

[45] Date of Patent: Mar. 22, 1994

[54] ELECTRIC CONNECTOR

[75] Inventors: Mitsuru Kawai; Masaru Yoshida; Eiji Kunii; Kouzou Uekido, all of Tokyo, Japan

[73] Assignee: Hirose Electric Co., Ltd., Tokyo, Japan

[21] Appl. No.: 958,233

[22] Filed: Oct. 8, 1992

[30] Foreign Application Priority Data

Oct. 23, 1991 [JP] Japan ..... 3-094654[U]
Oct. 23, 1991 [JP] Japan ..... 3-094655[U]

[51] Int. Cl.[5] ..... H01R 13/58

[52] U.S. Cl. ..... 439/455; 439/447; 439/466

[58] Field of Search ..... 439/453, 455, 465, 466, 439/467, 687, 696, 454, 447, 445

[56] References Cited

U.S. PATENT DOCUMENTS

| | | | |
|---|---|---|---|
| 2,508,638 | 5/1950 | Bricker | 439/455 |
| 3,867,006 | 2/1975 | Jeffres | 439/455 |
| 4,108,527 | 8/1978 | Douty et al. | 439/465 |
| 4,310,213 | 1/1982 | Fetterolf, Sr. et al. | 439/455 |
| 4,842,549 | 6/1989 | Asick et al. | 439/455 |
| 4,990,103 | 2/1991 | Sazaki et al. | 439/455 |

FOREIGN PATENT DOCUMENTS

| | | | |
|---|---|---|---|
| 1490668 | 6/1969 | Fed. Rep. of Germany | 439/465 |

*Primary Examiner*—Gary F. Paumen
*Attorney, Agent, or Firm*—Rosen, Dainow & Jacobs

[57] ABSTRACT

An electric connector is comprised of: a housing; a clamper for clamping a multicore cable formed with a plurality of sheathed cable elements bound by an outer jacket, a predetermined length of the outer jacket at an end thereof being removed; and a contact holder accommodated and held in the housing, a portion of the contact holder projecting from the housing being adapted to be inserted into a mating connector. The clamper includes a clamper body for clamping the outer jacket and a wing-like portion projecting radially from the clamper body. Contacts are fitted in the contact holder in such a manner as to be respectively connected to tips of core wires which are exposed with portions of respective sheaths of the plurality of sheathed cable elements removed. The housing is constituted by two split housing portions to allow the housing to be split into two at a plane including the axis of the multicore cable or a plane parallel with that plane, and the wing-like portion of the clamper is accommodated in a retaining groove formed in one of the split housing portions. The two split housing portions can be coupled with each other as a hook-like retaining leg formed on one of the two split housing portions in such a manner as to project from a splitting plane is retained at a retaining through hole formed in the other.

11 Claims, 4 Drawing Sheets

ELECTRIC CONNECTOR

BACKGROUND OF THE INVENTION

1. Field of the Invention

The present invention relates to an electric connector with a cable, and more particularly to an electric connector for securing a cable to a housing and to an electric connector whose housing is of a split type.

2. Description of the Related Art

As an electric connector with a cable of this type, such as the one shown in FIG. 4 is known. The electric connector shown in the drawing comprises the following: a soft resilient sleeve 51 which is easily deformable and is exteriorly fitted over an end of an outer jacket of a cable with contacts (not shown); a contact holder 52 for accommodating and holding the contacts of the cable with contacts and adapted to be inserted into a mating connector in an opening of a housing; a coupling metal fitting 53 for coupling together the resilient sleeve 51 and the contact holder 52; and a housing 54.

An annular groove is formed in a outer peripheral surface of each of the resilient sleeve 51 and the contact holder 52. Meanwhile, the coupling metal fitting 53 has finger-like retainers 53A, 53C which are made to undergo elastic deformation in an annular shape with respect to these annular grooves to retain the resilient sleeve 51 and the contact holder 52, as well as a coupling portion 53B for coupling the proximal portion of the retainers 53A, 53C. The coupling portion 53B is provided with a threaded hole for a fixing screw 55, and is fixed by means of the housing 54 and the screw 55.

When such a conventional electric connector with a cable is used, after the resilient sleeve 51 is first exteriorly fitted over an outer-jacket portion of the cable with contacts, each contact is fitted in the contact holder. Subsequently, after the retainers 53A, 53C of the coupling metal fitting 53 are held in the respective grooves in the resilient sleeve 51 and the contact holder 52, the retainers 53A, 53C are crimped into an annular shape. Since the resilient sleeve 51 is soft, as the retainer 53A is crimped, the cable in the resilient sleeve is also securely tightened. Thus, the cable is secured to the contact holder 52 via the coupling metal fitting 53. Furthermore, after the housing 54 is exteriorly fitted over the assembly, the coupling metal fitting 53 and the housing 54 are secured by means of the screw 55. As a result, the cable is also secured to the housing, so that even if the cable is pulled in the longitudinal direction thereof, the cable is prevented from being drawn out easily, and an undesirable external force is prevented from being imparted to connecting portions of the cable with respect to its contacts.

With the above-described conventional electric connector of the type in which the cable is fixed, its structure becomes large-scaled because the retainers are provided at opposite ends of the coupling metal fitting, and because it is necessary to provide the coupling portion for connecting them and having the threaded hole for fixing. In particular, its dimension in the longitudinal direction of the cable becomes large. This is undesirable for the electric connectors which are required to be compact in size. Such being the case, however, if the coupling metal fitting is made excessively small, the screw becomes small and the strength becomes insufficient, so that the function of the coupling metal fitting becomes insufficient. Furthermore, since the number of component parts used increases, resulting in higher manufacturing costs and making it impossible to improve the operating efficiency.

In addition, as for the electric connector, there are cases where the cable, which is connected to the connectors embedded in the housing, needs to be reconnected because of an erroneous connection, short-circuiting, or disconnection.

To meet this requirement, an electric connector is known in which the housing is made capable of being disassembled at a plane including the axis of the cable. This known electric connector is arranged such that two-split housing portions permitting disassembly are connected together by means of a screw to form a housing. Another electric connector of this type is arranged such that a resilient sleeve is exteriorly fitted over the housing.

With the above-described known electric connectors, however, although the cable after being once connected can be disassembled and reconnected, the disassembly of the housing and connection are quite troublesome. Furthermore, since a space for the threaded hole and an extra, necessary minimum wall thickness for securing the strength of the threaded hole portion are required, the housing becomes disadvantageously large-sized. In the case of a small connector, in particular, the screw itself becomes small in diameter and becomes quite inconvenient to handle, and it is difficult to secure the aforementioned space for the threaded hole and the wall thickness of the surrounding portion.

SUMMARY OF THE INVENTION

Accordingly, a primary object of the present invention is to provide an electric connector with a cable having a cable-fixing structure which has sufficient strength and makes it possible to obtain a compact size, thereby overcoming the above-described drawbacks of the conventional art.

A secondary object of the present invention is to provide an electric connector which is sufficiently applicable to a compact electric connector and in which the disassembly and reassembly of its housing are simple.

To attain the above-described primary object of the invention, in accordance with a first aspect of the invention, there is provided an electric connector comprising: a housing; a clamper for clamping an outer jacket of a multicore cable which is formed with a plurality of sheathed cable elements bound by said outer jacket, a predetermined length of said outer jacket at an end thereof being removed; and a contact holder accommodated and held in said housing, a portion of said contact holder projecting from said housing being adapted to be inserted into a mating connector, wherein said clamper includes a clamper body for clamping said outer jacket and a wing-like portion projecting radially from said clamper body, wherein contacts are fitted in said contact holder in such a manner as to be respectively connected to tips of core wires which are exposed with portions of respective sheaths of said plurality of sheathed cable elements removed, and wherein said housing is constituted by two split housing portions to allow said housing to be split into two at a plane including the axis of said multicore cable in a range covering said clamper, and said wing-like portion of said clamper is accommodated in a retaining groove formed in one of said slit housing portions, so as to couple said two split housing portions.

The electric connector with a cable in accordance with the first aspect of the invention is fabricated in the following procedure:

(1) First, the outer jacket of the multicore cable is removed by a predetermined length to set the end portions of the sheathed cable elements in a free state, and the sheaths of the sheathed cable elements are also removed by a predetermined length, and the contacts are connected to the core wires.

(2) The contacts are fitted in predetermined contact-holding holes in the contact holder.

(3) Then, the clamper body of the clamper is crimped to clamp an end of the outer jacket of the multicore cable. It should be noted that the fitting of the clamper may be effected prior to the aforementioned step (2) after the outer jacket has been removed in step (1) above.

(4) Subsequently, the wing-like portions of the clamper are accommodated in the retaining grooves in one of the split housing portions.

(5) Finally, the two split housing portions are coupled with each other, thereby completing the operation.

To attain the above-described secondary object of the invention, in accordance with a second aspect of the invention, there is provided an electric connector comprising: a housing; and a contact holder accommodated and held in said housing, a portion of said contact holder projecting from said housing being adapted to be inserted into a mating connector, wherein said contact holder has a contact insertion hole for fitting a contact connected to a tip of a core wire which is exposed with a portion of an outer jacket of a cable removed, and wherein said housing is constituted by two split housing portions to allow said housing to be split into two at a plane including the axis of said cable or at a plane parallel with said plane, and said two split housing portions are adapted to hold said contact holder and said cable and are capable of being coupled with each other as a hook-like retaining leg formed on one of said two split housing portions in such a manner as to project from a splitting plane is retained at a retaining through hole formed in the other one of said two split housing portions.

In accordance with the second aspect of the invention, assembly or reconnection of the electric connector is effected as follows:

(1) First, when the cable is newly connected to the electric connector, the cable with contacts connected thereto is fitted by inserting the contacts into the contact inserting holes in the contact holder.

(2) This contact holder and the cable extending therefrom are accommodated in predetermined positions between the two split housing portions. At that time, the retaining leg of one split housing portion is inserted into the retaining through hole formed in the other split housing portion.

(3) Then, the two split housing portions are strongly pressed against each other to allow the retaining leg to be retained at the through hole. This completes the electric connector with a cable.

(4) Subsequently, when the housing of the above-described electric connector is to be split for some reason or other, a distal end of the retaining leg is pressed from the outer opening side of the retaining through hole in one split housing portion in a direction in which the retention is canceled by using an appropriate tool, so as to separate the two split housing portions. Thus, after the contact holder is removed and reconnection is effected, the electric connector is reassembled in the procedure stated in steps (1) to (3) above.

As described above, in accordance with the first aspect of the present invention, since the cable is secured to the housing by using the clamper having the wing-like portions, the connector can be arranged with a simple and compact structure. As a result, it is possible to reduce the cost, improve the operating efficiency, and render an apparatus using the connector compact in size.

In addition, in accordance with the second aspect of the present invention, the arrangement provided is such that the housing is formed by two split housing portions, the retaining leg projecting from a splitting plane is provided on one of the split housing portions, and the retaining through hole is formed in the other split housing portion for receiving and retaining the retaining leg. Hence, the widthwise and lengthwise dimensions of the housing are prevented from becoming large, so that it is possible to provide a compact electric connector, and the housing can be readily split by using a tool from the outer opening side of the retaining through hole, thereby improving the operating efficiency.

The above and other objects, features and advantages of the invention will become more apparent from the following detailed description of the invention when read in conjunction with the accompanying drawings.

DESCRIPTION OF THE PREFERRED EMBODIMENT

Figure 1:
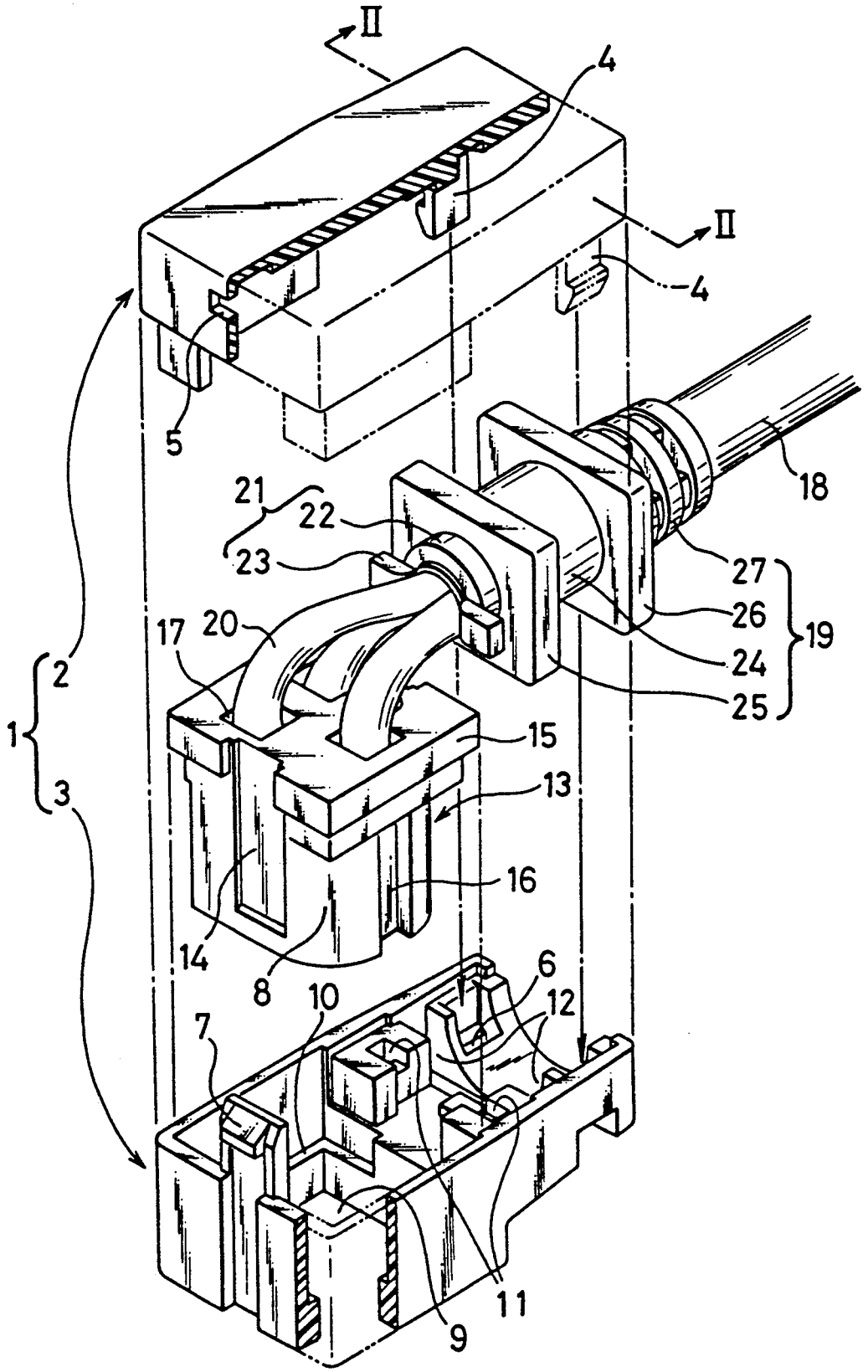
FIG. 1 is a partially fragmentary perspective view in which sections of an electric connector with a cable are shown in separated form in accordance with an embodiment of the present invention.
Figure 2:
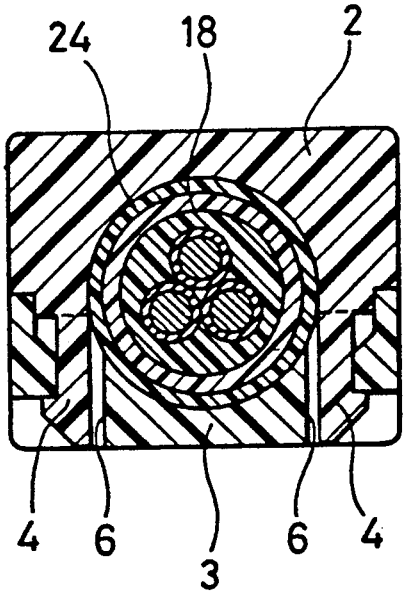
FIG. 2 is a cross-sectional view taken along line II—II in FIG. 1 after assembly of the connector.
Figure 3:
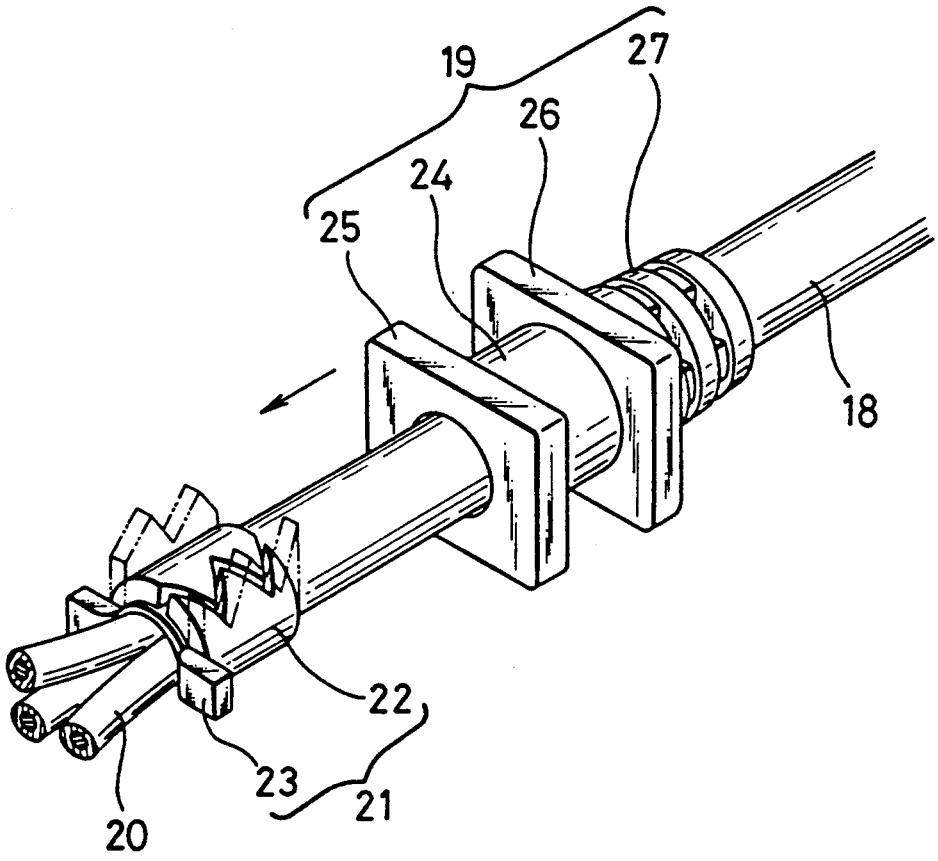
FIG. 3 is a perspective view of a cable having both a clamper and a resilient sleeve shown in FIG. 1.
Figure 4:
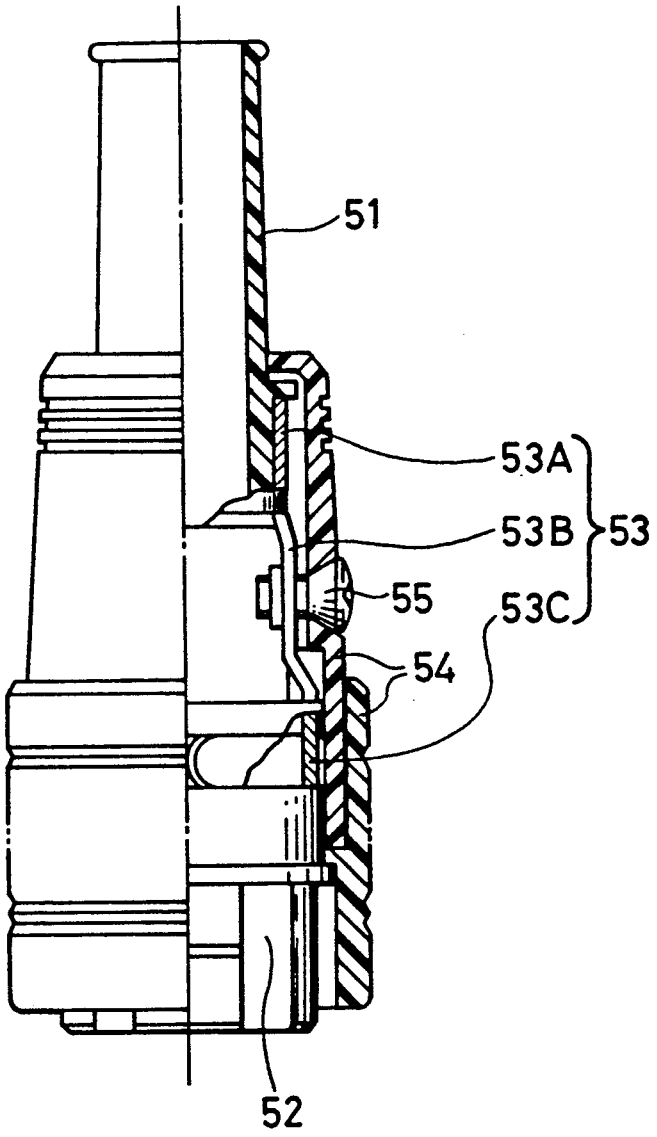
FIG. 4 PRIOR ART
FIG. 4 is a cross-sectional view of a conventional electric connector.

Referring now to FIGS. 1 to 3, a description will be given of an embodiment of the present invention.

FIG. 1 is a partially fragmentary perspective view in which sections are shown in separated form when a cable is connected to an electric connector in accordance with this embodiment;

FIG. 2 is a cross-sectional view taken along line II—II in FIG. 1 after assembly; and FIG. 3 is a perspective view illustrating a state in which the cable to be accommodated in a housing is clamped by a clamper.

In FIG. 1, a housing 1 comprises upper and lower two-split housing portions 2, 3 which are split at a plane including the axis of a multicore cable to be accommodated therein. This splitting plane may not necessarily be a plane including the axis, but may be a plane parallel with the same.

The upper split housing portion 2 is provided with retaining legs 4 having an arrowhead-like retaining hook as well as a retaining through hole 5 for engaging the retaining leg of the lower split housing portion 3. Each of the aforementioned retaining legs 4 of the upper split housing portion 2 and the retaining leg (which will be described later) of the lower split housing portion 3 projects from the splitting plane of the upper and lower split housing portions 2, 3. Accordingly, the widthwise and lengthwise dimensions of the housing are prevented from becoming large due to the retaining legs by those portions. In addition, the retaining through hole is formed through the housing wall.

Meanwhile, the lower split housing portion 3 is provided with retaining through holes 6 (see FIG. 2 as well) into which the retaining legs 4 of the upper split housing portion 2 are respectively inserted for retention, as well as a retaining leg 7 having a retaining hook for retaining the upper split housing portion 2 at the retaining through hole 5 thereof. In addition, the lower split housing portion 3 has a square insertion hole 9 formed in such a manner as to extend downward therethrough for guiding a contact holder 8, which will be described later, and allowing the same to be inserted therethrough. The aforementioned retaining leg 7 is disposed on one side of the inner wall of the insertion hole 9 in such a manner as to project slightly into the insertion hole 9 to secure the orientation of the contact holder 8 in the circumferential direction thereof when the contact holder 8 is inserted. In addition, a stepped portion 10 for determining the position of the contact holder 8 in the inserting direction thereof is formed at an intermediate portion of the inner wall surface of the insertion hole 9.

Furthermore, the lower split housing portion 3 is provided with a pair of retaining grooves 11 for receiving wing-like portions of the clamper which will be described later, and a pair of retaining grooves 12 located adjacent to the same for receiving one flange of a resilient sleeve which will be described later. It should be noted that the upper split housing portion 2 is similarly provided with retaining grooves corresponding to the aforementioned grooves.

A contact holder 13 which is inserted into the insertion hole 9 in the lower split housing portion 3 has a square hollow cylindrical configuration conforming to the insertion hole 9. The contact holder 13 has a guide groove 14 in its peripheral surface for guiding the retaining leg 7 for determining the orientation of the contact holder 13 in the circumferential direction thereof. The contact holder 13 has a flange 15 at an upper portion thereof, and this flange 15 serves as a stopper which is engaged with the stepped portion 10 at the insertion hole 9 of the lower split housing portion 3. When the contact holder 13 is inserted into the insertion hole 9 until the flange 15 abuts against the stepped portion 10, the contact holder 13 projects downward from the lower split housing portion 3, and the projecting portion becomes a portion which is fitted with a mating connector (not shown). At that time, another guide groove formed in the peripheral surface of the contact holder 13 serves to determine the orientation of insertion into the mating connector in the circumferential direction thereof.

In addition, contacts (not shown) respectively connected to the core wires of sheathed cable elements 20 of a multicore cable 18 are fitted in respective contact insertion holes 17 of the contact holder 13.

After a resilient sleeve 19 is exteriorly fitted over the multicore cable 18, the outer jacket which binds the plurality of the sheathed cables 20 is removed at a tip thereof by a predetermined length (see FIG. 3). Then, the sheaths of the unbound sheathed cables 20 are removed at tips thereof, and the contacts (not shown) are connected to the core wires.

The above-described multicore cable 18 with contacts is clamped by a clamper at an end of the outer jacket thereof. The clamper 21 is comprised of a clamper body 22 and a pair of wing-like portions 23. The clamper body 22 has a U-shaped cross section and constitutes a retainer. Its ends are shaped in the form of sawteeth. The wing-like portions 23 formed integrally with the clamper body 22 extend in the radial direction of the cable. When the clamper 21 having the above-described arrangement is used, the clamper body 22 serving as the retainer is crimped into the shape of a cylindrical tube and is tightly pressed against the outer jacket of the multicore cable 18, as shown in FIG. 3.

The resilient sleeve 19 has a hollow cylindrical portion 24 guided on the outer jacket of the multicore cable 18, a pair of flanges 25, 26 disposed at opposite ends thereof, and a protective portion 27 disposed at a rear end thereof and provided with grooves so as to be made more flexible. This resilient sleeve 19 is strongly pushed over the clamper body 22 of the clamper 21, as shown in FIG. 3, such that the inside diameters of the front flange 25 and the hollow cylindrical portion 24 are enlarged through resilient deformation, thereby allowing these portions of the resilient sleeve 19 to be exteriorly fitted over the clamper body 22 (see FIG. 2).

In the above-described embodiment, the electric connector with a cable is fabricated in the following procedure:

(1) First, as shown in FIG. 3, the resilient sleeve is strongly pushed over the clamper body 22 of the clamper 21.

(2) In FIG. 1, the contact holder 13 with the contacts fitted therein is inserted into the insertion hole 9 in the lower split housing portion 3. At the same time, the wing like portions 23 of the clamper 21 are accommodated in the retaining grooves 11 in the lower split housing portion 3, while the front flange 25 of the resilient sleeve 19 is accommodated in the retaining grooves 12. It should be noted that, at that time, the rear flange 26 of the resilient sleeve 19 is located outside the lower split housing portion 3 and is adapted to be retained at a rear-end face thereof.

Thus, the cable is secured to the housing by means of the wing-like portions 23 of the clamper 23 in the longitudinal direction thereof.

(3) Subsequently, the upper split housing portion 2 is coupled with the lower split housing portion 3 by causing their retaining legs 4, 7 to be retained at the corresponding retaining through holes 6, 5, respectively. As a result, the cable and the contact holder are held while they are being positioned in the vertical direction.

(4) Next, when the cable is reconnected, an appropriate tool is applied to the retaining through holes 5, 6, and a thin-blade member is inserted between the splitting planes of the housing while the retaining hooks of the retaining legs 4, 7 are being pushed in the direction in which the retention is canceled, thereby splitting the two split housing portions 2, 3. Subsequently, the contact holder 13 is drawn out, and reconnection of the cable is effected, whereupon the electric connector is reassembled in the procedure stated in steps (1) to (3) above.

What is claimed is:

1. An electric connector comprising:

a housing;

a clamper for clamping an outer jacket of a multicore cable which is formed with a plurality of sheathed cable elements bound by said outer jacket, a predetermined length of said outer jacket at an end thereof being removed; and a contact holder accommodated and held in said housing, a portion of said contact holder projecting from said housing being adapted to be inserted into a mating connector, wherein said clamper includes a clamper body for clamping said outer jacket and a wing-like portion projecting radially from said clamper body, wherein contacts are fitted in said contact holder in such a manner as to be respectively connected to tips of core wires which are exposed with portions of respective sheaths of said plurality of sheathed cable elements removed, and wherein said housing is constituted by two split housing portions to allow said housing to be split into two at a plane including the axis of said multicore cable in a range covering said clamper, and said wing-like portion of said clamper is accommodated in a retaining groove formed in one of said slit housing portions, and wherein said clamper body is deformed into a cylindrical shape by clamping said multicore cable, and a flexible sleeve formed of a resilient material is exteriorly fitted over at least a rear portion of said clamper body with resilient pressure.

2. An electric connector comprising a housing, a contact holder which is adapted to receive contacts on the ends of a cable, and retainer means, the housing comprising first and second mating parts and fastener means for releasably coupling said first and second parts, said contact holder dimensioned to fit within said housing, said retainer means comprising a clamper for partially encompassing the cable generally coaxially therewith, said clamper being crimpable to tightly engage said cable, said clamper further comprising at least one projection extending transversely of the axis of the sleeve, and a resilient sleeve with at least one transversely extending flange, this sleeve having a bore adapted to receive said cable therethrough, said resilient sleeve when situated about said cable adapted to be moved axially and to resiliently encompass in its bore and tightly engage said clamper, and said housing further comprising first receiving means for engaging said clamper projection, and second receiving means for engaging said contact holder.

3. An electric connector according to claim 2 wherein said housing holds said contact holder, retainer means and cable in an orientation where the cable is bent in a generally 90° turn.

4. An electric connector according to claim 3 wherein said contact holder is oriented generally normal to the axis of said cable when said contact holder and retainer means are secured in said housing.

5. An electric connector according to claim 2 wherein said first receiving means comprises a recess for receiving the clamper's projection.

6. An electric connector according to claim 2 wherein said housing parts comprise upper and lower elements separable from each other along a plane generally parallel with the cable.

7. An electric connector according to claim 2 wherein said resilient sleeve comprises a first flange, and a third receiving means of said housing comprises a recess for receiving said first flange.

8. An electric connector according to claim 7 wherein said resilient sleeve further comprises a second flange axially spaced from the first flange, said second flange engaging an outer surface of said housing.

9. An electric connector according to claim 2 wherein said clamper is initially a generally U-shape sleeve which is crimpable into a generally cylindrical shape.

10. An electric connector according to claim 9 wherein said clamper comprises a generally rectangular strip formed into a U-shape, the strip having saw-tooth ends which mate when the strip is crimped about the cable.

11. An electric connector according to claim 2 wherein said contact holder when secured in said housing has a part thereof extending outside of said housing.

* * * * *

UNITED STATES PATENT AND TRADEMARK OFFICE

CERTIFICATE OF CORRECTION

PATENT NO. : 5,295,859

DATED : March 22, 1994

INVENTOR(S) : Mitsuru Kawai; Masaru Yoshida; Eiji Kunii; Kouzou Uekido

It is certified that error appears in the above-identified patent and that said Letters Patent is hereby corrected as shown below:

TITLE PAGE, ASSIGNEE SHOULD READ AS FOLLOWS:

[73] Assignees: Hirose Electric Co., Ltd., Tokyo, Japan

NEC Corporation, Tokyo, Japan

Signed and Sealed this

Seventh Day of February, 1995

*Attest:*

Bruce Lehman

BRUCE LEHMAN

*Attesting Officer*

*Commissioner of Patents and Trademarks*